US005184827A

United States Patent [19]

Suttle et al.

[11] Patent Number: 5,184,827

[45] Date of Patent: Feb. 9, 1993

[54] AUDIBLE GOLF GLOVES

[76] Inventors: Keith H. Suttle, P.O. Box 4171, Wilmington, N.C. 28406; William J. McGraw, P.O. Box 5209, Wrightsville Beach, N.C. 28480

[21] Appl. No.: 825,061

[22] Filed: Jan. 24, 1992

[51] Int. Cl.[5] ..... A63B 69/36

[52] U.S. Cl. ..... 273/187.2; 273/DIG. 30; 2/161 A

[58] Field of Search ..... 273/DIG. 30, 187.4, 273/187.5, 187.2, 166, 165; 2/161 A, 159, 161 R

[56] References Cited

U.S. PATENT DOCUMENTS

| | | | |
|---|---|---|---|
| 3,680,869 | 8/1972 | Brady | 273/183 B |
| 4,665,565 | 5/1987 | Odom | 273/DIG. 30 |
| 5,028,050 | 7/1991 | Freyer | 273/187.2 |

*Primary Examiner*—George J. Marlo
*Attorney, Agent, or Firm*—Rhodes, Coats & Bennett

[57] ABSTRACT

A pair of golf gloves for teaching a golfer to maintain his grip about a golf club during a golf swing. The pair of golf gloves comprises of a control-hand glove which fits about a golfer's control hand and a power-hand glove which fits about a golfer's power hand. The control-hand and power-hand gloves are designed with an audible emitter which audibly signals to the golfer when the golfer's hands initially begin to break or separate during the golf swing. The audible emitter consists only of a first cooperating VELCRO® section strategically attached to the control-hand glove and a second VELCRO® section strategically attached to the power-hand glove. The first VELCRO® section located about the palm side of the base area of the thumb of the control-hand glove, and the second VELCRO® section located about the palm side along the lower base area of the power-hand glove. The cooperating first and second VELCRO® sections mate when the golfer assumes a golf grip about a club handle, and are strategically positioned on the gloves to mate together at the location where the golfer's hands have a tendency to initially begin to separate during a golf swing. The mated first and second VELCRO® sections separate as the golfer's hands come apart during a golf swing, and cause an audible sound to be produced. The audible sound signals to the golfer the point in the golf swing where the grip about the golf-club handle was initially released.

6 Claims, 2 Drawing Sheets

AUDIBLE GOLF GLOVES

FIELD OF THE INVENTION

The present invention relates generally to golf gloves, and more particularly, to a pair of golf gloves that audibly signals to a golfer when the golfer improperly breaks his grip about a golf club during his golf swing.

BACKGROUND OF THE INVENTION

Developing a proper golf swing is crucial in developing a successful golf game. Various training aids have been developed to aid golfers in improving their golf swing, but these prior art teaching aids have not adequately or successfully addressed a crucial point in the breakdown of the golf swing. As discussed in U.S. Pat. No. 4,665,565, issued May 19, 1987, one important aspect in the golf swing is maintaining a firm grip about the golf club throughout the golfer's backswing.

There is, however, a tendency in many golfers to temporarily release the grip about the golf club during the golfer's backswing and then to regrip the golf club during the downswing. Several problems tend to result from improperly breaking the golf grip. First, the golf club tends to rotate slightly in the hands as the golf grip is released, causing the golf club to become improperly orientated with relation to the golf ball being struck. Likewise, separation of the hands also tends to cause a golfer to take a longer backswing which results in a less controlled golf swing. In addition, the breakage of the hands during the swing interferes with the proper weight shift that should occcur during the swing, and in particular, causes the left side of the golfer (for a right-handed golfer) to break down during club impact with the golf ball.

U.S. Pat. No. 4,665,565, issued May 19, 1987, attempts to solve this problem of the hands breaking during the golf swing through the use of a pair of golf gloves designed to lock the golfer's hands together about the golf club. In order to lock the golfer's hands together to prevent the golfer from breaking his grip, the gloves disclosed in U.S. Pat. No. 4,665,565 have VELCRO® fasteners located on numerous locations about both gloves. As with other prior art, the inventor of U.S. Pat. No. 4,665,565 approaches the problem of the breakage of the hands during the golf swing by designing a product to prevent the golfer's hands from coming apart during the swing.

Various other patents have disclosed devices for locking the hands together. U.S. Pat. No. 4,752,075, issued Jun. 21, 1988, for instance, teaches a training type glove that interlocks the golfer's hands to help prevent and tactically indicate the breakage of the golfer's hands during the golf swing. Still another example of the prior art for locking a golfer's hands together is shown in U.S. Pat. No. 2,852,779, issued Sep. 23, 1958, which discloses a device having a strip for holding the grip portion of a golf club against the player's hand. U.S. Pat. No. 3,725,957, issued Apr. 10, 1973, discloses a single glove structure for both hands which locks the two hands together about a golf-club handle.

Other golf training devices have been used to address other aspects of the golf swing. For instance, to overcome sway in the golf swing, U.S. Pat. No. 3,985,364, issued Oct. 12, 1976, discloses a device which audibly signals to a golfer when the golfer has reached the peak of his backswing.

The prior art, since at least as 1958, has attempted to solve the problem of the breakage of the grip during the backswing by locking the hands together or onto the golf club. These prior art devices all teach a training aid for physically locking the golfer's hands together or on to the club in order to prevent the golfer from separating his hands during the backswing. The problem with these devices for physically locking the hands together is that these training aids are often uncomfortable to play with and also do not account for the numerous grips that individual golfers may assume. In addition, these golf training aids may make it difficult for a golfer to grip the golf-club handle with his individualized golf grip and then to make adjustments in the golf grip.

SUMMARY AND OBJECTS OF THE PRESENT INVENTION

The present invention is a pair of golf gloves for teaching a golfer to maintain his grip about a golf-club handle during a golf swing. The pair of golf gloves includes an audible signal emitter for producing an audible sound that signals to the golfer when the golf grip is initially broken during the golf swing.

The audible emitter includes a first VELCRO® section attached to a control-hand glove and a second VELCRO® section attached to a power-hand glove. The first VELCRO® section is attached about the palm side in the thumb area of the control-hand glove, while the second VELCRO® section is attached about the palm side in the lower base area of the power-hand glove.

When a golfer wearing the audible gloves grips a golf-club handle, the first and second VELCRO® sections are pressed together and mated. The first and second VELCRO® sections are strategically positioned at the location where a golfer's hands first tend to separate during a golf backswing. Because of the positioning of the VELCRO® sections on the gloves, the audible emitter produces an audible signal to the golfer when the golfer's grip initially begins to release during the golf backswing. A golfer can use the present invention gloves to get audible feedback on when his golf grip is released, and with this audible information more easily eliminate the problem of breaking his golf grip during the golf swing.

It is therefore an object of the present invention to provide a pair of golf gloves that produces an audible signal when a golf grip is broken during a golf backswing.

Another object of the present invention is to provide a pair of golf gloves that produces an audible signal when the hands initially begin to break during the golf backswing.

Another object of the present invention is to locate an audible emitter on a pair of gloves at the location where a golfer's grip tends to initially begin to break during the golf backswing.

Another object of the present invention is to provide a pair of golf gloves that provides audible feedback to golfers who may assume a wide variety of individualized golf grips.

Another object of the present invention is to provide a teaching aid for audibly indicating when a golfer initially breaks his grip while minimizing the degree to which the hands are attached together about a golf-club handle.

Another object of the present invention is to provide a pair of golf gloves that does not lock a golfer's hand to the golf-club handle.

Another object of the present invention is to provide a pair of golf gloves that allows freedom of movement for a golfer's fingers.

Other objects and advantages of the present invention will become apparent and obvious from a study of the following description and the accompanying drawings which are merely illustrative of such invention.

DETAILED DESCRIPTION OF THE INVENTION

Figure 1:
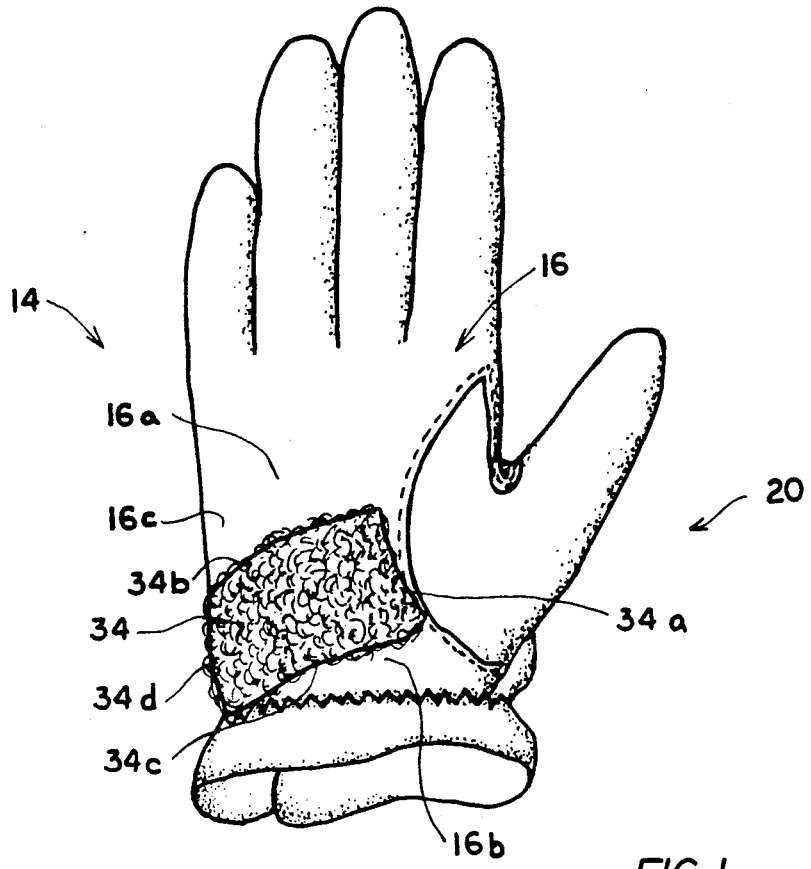
FIG. 1 is a perspective view of the power-hand glove that forms a part of the pair of golf gloves of the present invention.

With further reference to the drawings, a pair of golf gloves is shown therein and indicated generally by the numeral 10. It will be appreciated that the pair of golf gloves 10 shown are designed for a right-handed golfer. However, it will follow that the present invention can be incorporated into gloves for a left-handed golfer. For purposes of discussion and illustration, the left hand golf glove (FIG. 2) will be referred to as a control-hand glove 12, while the right hand glove (FIG. 1) will be referred to as a power-hand glove 14.

With further reference to the pair of golf gloves 10, it is seen that each glove includes a palm side indicated generally by the numeral 16 and a back side indicated by the numeral 18. A thumb panel, indicated generally by the numberal 20 is fit into the palm side of the glove and extends around to where the same is connected to the back side 18 of a respective glove. Viewing the palm side 16 in more detail, it is seen that the basic palm area of each glove is defined as including a central palm area 16*a*, a lower palm area 16*b*, and opposite the thumb panel 20 is a palm side 16*c* that is referred to as the little finger palm side.

Figure 3:
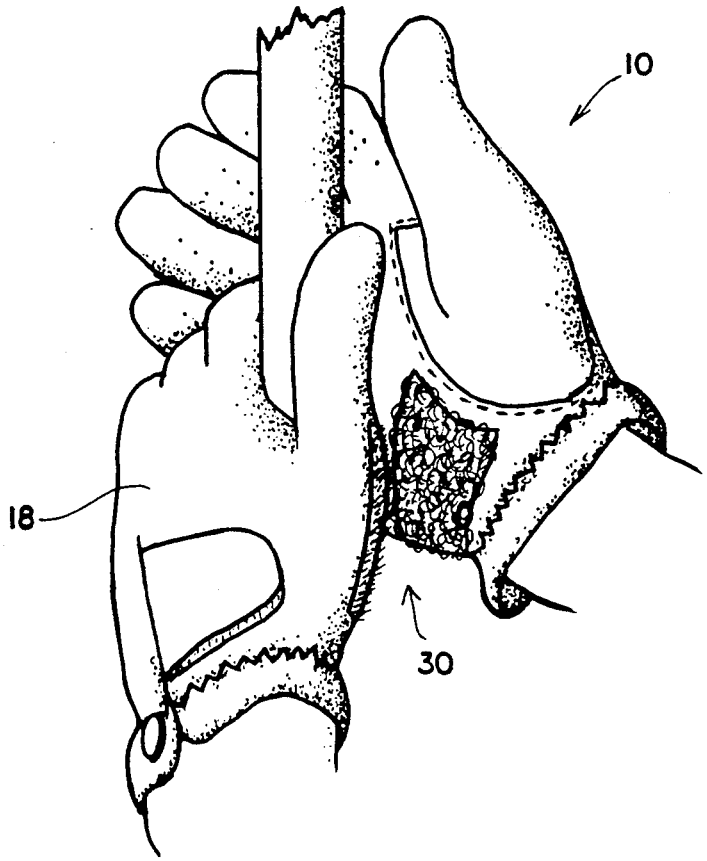
FIG. 3 is a perspective view of the pair of golf gloves of the present invention about to be gripped around a golf-club handle.

The pair of gloves 10 is provided with an audible emitter or indicator that is indicated generally by the numeral 30 (See FIG. 3). As will be appreciated from subsequent portions of this disclosure, the function of the audible emitter or indicator 30 is to appraise the golfer wearing the gloves 10 that he or she has developed an initial break in a proper golf grip. More particulary, the golf gloves 10 and the audible indicator 30 are designed such that when a selected proper grip is maintained about the golf club handle and the grip is maintained in a secure tight relationship about the handle, the audible emitter 30 is maintained in an inactive, non-indicating state. However, once a proper grip has been obtained, the audible emitter 40 functions to emit a signal, in this case an audible signal, in the event that there is an initial break in the golf grip. As will be appreciated from the subsequent portions of this disclosure, the present invention relies on mating VELCRO® strips to emit such an audible signal indicating the initial breakage of a proper golf grip.

Figure 2:
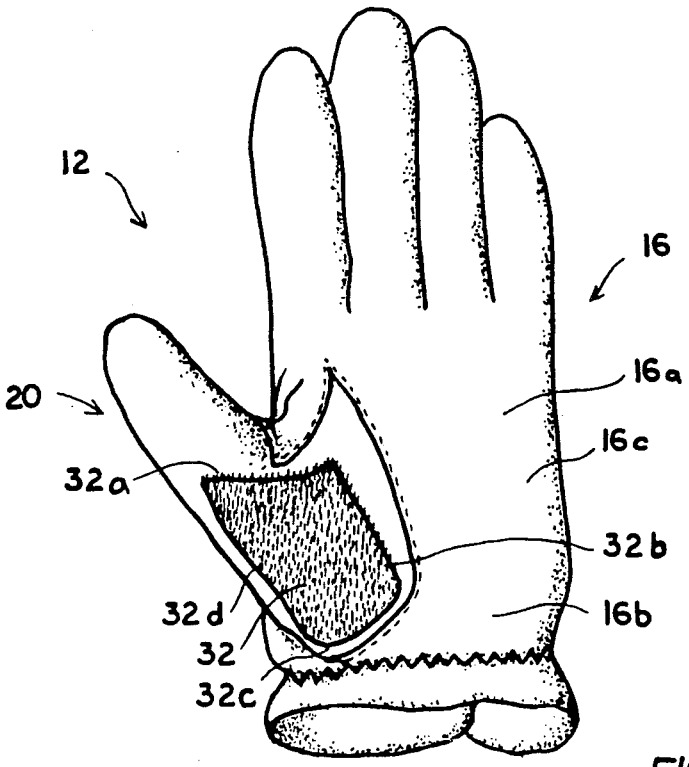
FIG. 2 is a perspective view of the control-hand glove that forms a part of the pair of golf gloves of the present invention.
Figure 4:
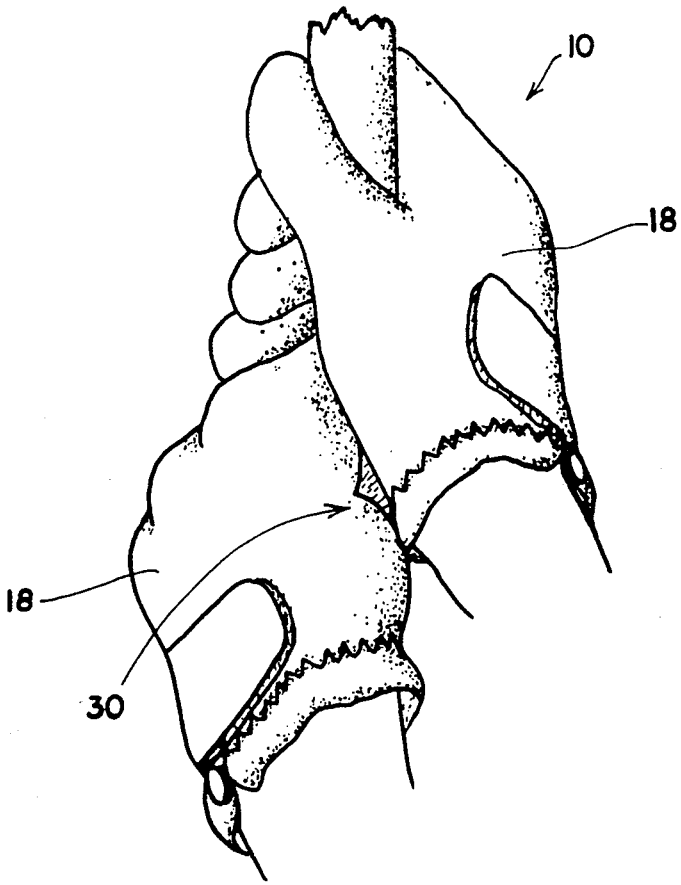
FIG. 4 is a perspective view of the pair of golf gloves of the present invention shown fully gripped about the handle of a golf club.

Viewing FIGS. 1 and 2, it is seen that the audible emitter or indicator 30 comprises two VELCRO® strips 32 and 34. VELCRO® strip 32 is disposed about the palm side adjacent the thumb panel 20 of the control-hand glove 12. VELCRO® strip 34 is disposed about the lower palm area 16*b* of the power-hand glove 14. As will be appreciated from studying this entire disclosure, VELCRO® strips 32 and 34 are designed to mate and attach when the golfer has made a selected proper grip about a golf-club handle, as shown in FIG. 4. Once that proper grip has been established, the VELCRO® strips 32 and 34 are designed to emit an audible signal if there is an initial break in the golfer's grip in the area where the two VELCRO® strips 32 and 34 mate and join each other. VELCRO® strips 32 and 34 are strategically placed so as to be operative over a selected range of proper grips. That is, VELCRO® strips 32 and 34 are particularly placed about the control-hand glove 12 and the power-hand glove 14 such that there will be substantial mating and interlocking between the VELCRO® strips 32 and 34 at a number of relative positions of the respective gloves 12 and 14. This means that the control-hand glove and powerhand glove can be adjusted relative to each other, and yet throughout this range of adjustment, there will be sufficient interlocking contact between the VELCRO® strips 32 and 34 such that the VELCRO® strips will be operative as a signal emitter to appraise the golfer of an initial break in his grip in the area occupied by the VELCRO® strips 32 and 34.

Viewing the control-hand glove 12 in more detail, it is seen that the VELCRO® strip 32 is placed about the thumb panel 20 just below the upper portion of the golfer's thumb when the palm side adjacent the glove 12 is fitted on the golfer's hand. Viewing VELCRO® panel 32 in more detail, it is seen that the same is basically aligned with the thumb receptacle of the glove 12 and includes an upper generally arcuate shaped edge 32*a*, a lower edge 32*c*, and a pair of generally parallel side edges 32*b* and 32*d*. As seen in FIG. 2, the remaining portion of the palm side 16 of the control-hand glove 12 is maintained free of VELCRO® or any other sound emitting device.

Turning to the power-hand glove 12 as shown in FIG. 1, it is seen that the VELCRO® strip 34 extends across the lower portion of the palm 16*b*. In particular, the VELCRO® strip 34 associated with the power-hand glove 14 includes an arcuate shaped edge 34*a* disposed adjacent a seam of the thumb panel 20. In addition, VELCOR® strip 34 includes an upper edge 34*b* and a lower edge 34*c*. VELCRO® panel 34 extends to the little finger side 16*c* of the palm and essentially terminates about the side edge of the glove 14. As seen in FIG. 1, VELCRO® strip 14 extends at a slight angle across the lower palm of the hand, and again forms the only sound emitting device attached to the glove 14.

As pointed-out above, VELCRO® strips 32 and 34 are strategically located about the respective gloves 12 and 14 and are provided with opposed and cooperating mating means. This, of course, means that one is of a loop construction, while the other is of a hook construction. As noted above, the respective strips 32 and 34 are particularly disposed on the respective gloves 12 and 14 such that when a proper grip is obtained around a golf-club handle such as illustrated in FIG. 4, the respective loops and hooks of a VELCRO® strip mate and connect with each other. It is important to appreciate that the purpose of the VELCRO® strips 32 and 34 associated with the pair of gloves 10 is not to retain a grip about a golf club handle, but to appraise the golfer that there is an initial break in his grip during a portion of his swing. To achieve this, the two VELCRO® strips 32 and 34 are selectively placed such that for a range of appropriate golf grips, the two VELCRO® strips will mate. The area of mating is defined as the critical engaged grip area. That is, when the golfer assumes a proper grip, the portions of the hand underlying the VELCRO® strips 32 and 34 should be engaged and are abutting against each other. The purpose of the present invention is to appraise the golfer that there is a break in his grip at the location defined by the engagement of the two VELCRO® strips 32 and 34.

In use, if a golfer's grip starts to break and there is even the slightest departure of one hand from the other hand in this critical area, the VELCRO® strip, as they are tearing apart, will emit a signal telling the golfer that there has been a fault or a breakage of his grip in this critical gripping area of the hand. It is appreciate that there are no other interlocking VELCRO® strips located on the glove except in this critical grip area.

From the foregoing discussion, it is appreciated that the present invention entails a very useful golf teaching aid that is simple and relatively inexpensive. VELCRO® strips 32 and 34 will, time after time, emit an audible signal that will appraise the golfer that a break or a fault has occurred at a critical area of his grip. By repeatedly hearing this audible signal, the golfer will learn to maintain a closed grip in this critical area, and consequently his golf game will improve.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A signal generating pair of golf gloves for emitting a sound signal in response to the golfer improperly breaking his grip about a golf club consisting essentially of:

a) a control-hand glove and a power-hand glove with each glove having a palm side with a central palm area and a little finger palm side area, a back side, a thumb area, and a plurality of fingers;

b) a signal emitter formed on the gloves for emitting an audible signal only in response to the golfer breaking his grip during the course of a swing;

c) the signal emitter consisting essentially of attaching loop and hook strips formed across the respective palms of the control-hand glove and power-hand glove, wherein when a proper grip is assumed the loop and hook strips mate and attach to each other but the force associated with a break in grip is sufficient to separate the strips such that when the golfer improperly breaks his grip a tear-away effect occurs as the loop strip tears away from the hook strip and an audible signal indicating the break of the grip results;

d) the signal producing loop and hook strips being strategically located about the palm sides of the control-hand glove and the power-hand glove to assure the integrity and reliability of the gloves as golf grip teaching aids, one of the loop and hook strips being secured to the control-hand glove about the palm side of the control-hand glove adjacent the thumb area leaving the finger tips and the base area of the palm devoid of any hook and loop strips;

e) the other of the hook and loop strips being secured to the palm side of the power-hand glove and spaced from the thumb area but extending transversely across the lower base area of the palm towards the little finger side of the palm leaving the upper central area of the palm and finger tips devoid of any hook and loop strips; and f) wherein the signal emitting gloves are effective to only emit a signal where there is a grip break between the hook and loop strips that is peculiarly related to the presence or absence of a proper golf grip, and wherein grip breaks between cooperating fingers or other palm areas fail to produce a signal since such is not paramount in teaching the maintenance of a proper grip throughout a swing.

2. The signal generating pair of golf gloves of claim 1 wherein the strip disposed on the control-hand glove includes a generally arcuate base edge, a pair of generally side edges, and a generally arcuate upper edge.

3. The signal generating pair of golf gloves of claim 1 wherein the strip disposed on the control-hand glove is elongated and disposed such that it extends in general alignment with the thumb.

4. The signal generating pair of golf gloves of claim 1 wherein the strip disposed on the power-hand glove is at least slightly elongated and is disposed diagonally across the lower base area of the palm.

5. The signal generating pair of golf gloves of claim 1 wherein the strip disposed on the power-hand glove includes upper and lower parallel edges.

6. A method of teaching a golfer to maintain a proper closed grip consisting essentially of the steps of:

a) instructing a golfer to use the gloves of any of claims 1–5 such that the hooks and loops mate and attach to form a signal emitter which is maintained in an inactive mode so long as the golfer maintains a proper closed grip on the handle of a golf club and a signal is emitted to the golfer only in response to the sensing of when the golfer initially begins to break his grip and thereby informing the golfer of a departure from the proper grip during the golf backswing.

* * * * *